US006923566B2

(12) United States Patent
Willbee, Jr.

(10) Patent No.: US 6,923,566 B2
(45) Date of Patent: Aug. 2, 2005

(54) PORTABLE DRUM JUMPER

(76) Inventor: Richard S. Willbee, Jr., 12665 Chippewa Trail, Rapid City, MI (US) 49676

( * ) Notice: Subject to any disclaimer, the term of this patent is extended or adjusted under 35 U.S.C. 154(b) by 170 days.

(21) Appl. No.: 10/247,718

(22) Filed: Sep. 20, 2002

(65) Prior Publication Data

US 2003/0223304 A1 Dec. 4, 2003

Related U.S. Application Data

(60) Provisional application No. 60/371,723, filed on May 29, 2002.

(51) Int. Cl.[7] ..... B28C 5/42; B01F 15/00

(52) U.S. Cl. ..... 366/61

(58) Field of Search ..... 366/1–2, 53–61, 366/349

(56) References Cited

U.S. PATENT DOCUMENTS

| | | | | |
|---|---|---|---|---|
| 3,136,165 A | | 6/1964 | Pitts | |
| 3,754,737 A | | 8/1973 | O'Dea | |
| 3,767,171 A | | 10/1973 | Dunmire | |
| 4,097,925 A | | 6/1978 | Butler, Jr. | |
| 4,487,507 A | | 12/1984 | Van Wyngaarden | |
| 4,542,990 A | | 9/1985 | Fouquet | |
| 4,786,179 A | | 11/1988 | Kaminski | |
| 5,076,703 A | * | 12/1991 | Loefke et al. | 366/61 |
| 5,348,387 A | * | 9/1994 | Gordon et al. | 366/63 |
| 5,489,150 A | | 2/1996 | Whiteman, Jr. | |
| 5,669,712 A | | 9/1997 | Bauermeister et al. | |
| 6,042,259 A | * | 3/2000 | Hines et al. | 366/17 |
| 6,286,987 B1 | * | 9/2001 | Goode et al. | 366/60 |

FOREIGN PATENT DOCUMENTS

DE 3214405 A1 * 10/1983

* cited by examiner

*Primary Examiner*—Charles E. Cooley
(74) *Attorney, Agent, or Firm*—Merek, Blackmon & Voorhees, LLC

(57) ABSTRACT

The current invention is to an arrangement for a portable emergency drum jumper that can be mounted to the mixer fender or mixer fender of a truck to provide emergency power to rotate the drum. The pump has been substantially reduced in size by rotating the drum at a reduced speed sufficient to mix in a retarder or water that will prevent the concrete for setting up to 24 hours to provide time to unload the concrete from the drum. Instead of attempting to duplicate the power and drum rotation rate of 12–14 rpm of a fully operational truck, the emergency drum jumper operates at a slower rate such as 2 rpm which is sufficient to mix the retarder or water fully into the concrete and to allow unloading of the concrete. While the higher speed of the fully operational truck allows for expedited on-site mixing of the concrete for a particular job, the lower speed of the emergency hydraulic pump of the current invention provides a fully capable system in a portable system which can be easily delivered on site.

8 Claims, 4 Drawing Sheets

PORTABLE DRUM JUMPER

CROSS-REFERENCE TO RELATED APPLICATION

This application claims the benefit of U.S. Provisional Application No. 60/371,723, filed May 29, 2002.

BACKGROUND OF THE INVENTION

A. Field of the Invention

The present invention relates to a novel arrangement and method for the emergency rescue and unloading of an incapacitated ready mix truck.

B. Description of the Prior Art

It is well known in the art to supply concrete to a construction site using a ready mix truck. The drum, which contains and mixes the water and other ingredients into the cement or concrete, typically spins at 12–14 rpm to thoroughly mix the components together. The drum is operated (rotated) by a hydraulic motor connected to a gearbox connected to the base of the drum. The hydraulic motor is powered by a hydraulic pump driven by a drive shaft connected to the front of the truck engine. When power from the motor is interrupted because of engine failure or a myriad of other reasons, the drum quits rotating. If the drum is stationary, then the concrete will start to set ("harden") in the drum. After a period of time, which can be as short as one half hour to 3 hours depending on the particular mix and other variables, the concrete will set in the drum potentially ruining the drum.

After the concrete has hardened in the drum, it is common procedure to remove and replace the drum at considerable cost, including the crane required to lift the drum off the truck and place the new one on the truck. The operator may also suffer a period of down time waiting for a new drum to be delivered. As an option, a jack hammer operator can be inserted into the drum to jack hammer the concrete out of the drum. This may be a considerably lengthy and costly process depending on the amount of concrete in the drum. The manager faced with the decision to try and save the drum by using a jack hammer operator may also be faced with strict OSHA, EPA and other agency requirements for ensuring the safety and well being of the jack hammer operator while working inside the drum thereby increasing the cost of the repair.

There have been several attempts to maintain the drum in motion or to restart the drum after power from the motor is interrupted. One such device is shown in U.S. Pat. No. 4,097,925 to Butler, Jr. The patent shows a hydraulic emergency power unit mounted on a trailer which can be driven to the truck and linked to the hydraulic system of the truck to rotate a drum of a failed mixer truck to unload the concrete. However this system requires an extensive trailer system and may not be agile enough to reach construction locations where the ready mix trucks typically frequent. It may also be logistically difficult to secure a second truck with a hitch to pull the trailer or to find an operator to drive the truck. As well, it may be difficult to maneuver the trailer into a position close enough to link the hydraulic hoses of the trailer mounted pump to the hydraulic motor of the ready mix drum.

The current invention proposes an arrangement for a portable emergency drum jumper which can be mounted to the mixer fender or mixer fender of a truck to provide emergency power to rotate the drum. The pump has been substantially reduced in size by rotating the drum at reduced speed sufficient to mix in a retarder or water that will prevent the concrete for setting up to 24 hours to provide time to unload the concrete from the drum. Instead of attempting to duplicate the power and drum rotation rate of 12–14 rpm of a fully operational truck, the emergency drum jumper operates at a slower rate such as 2 rpm which is sufficient to mix the retarder or water fully into the concrete and to allow unloading of the concrete. While the higher speed of the fully operational truck allows for expedited on-site mixing of the concrete for a particular job, the lower speed of the emergency hydraulic pump of the current invention provides a fully capable portable system which can be easily delivered on site.

SUMMARY OF THE INVENTION

A preferred embodiment of the present invention is directed to installing an emergency hydraulic pump with its own motor unit on the mixer fender of a ready mix truck to provide hydraulic power to rotate the drum of the ready mix truck. By removing the high pressure hydraulic lines and the bleed line connected between the engine-run pump and the hydraulic motor on the ready mix truck and then connecting the hydraulic lines from the emergency pump to the hydraulic motor, emergency power can be provided to rotate the drum. By providing a pump which is powerful enough only to rotate the drum a speed sufficient to mix in a retarder or water and to unload the concrete from the truck, a portable unit can be designed which can be delivered by an automobile or smaller vehicle such as an ATV and mounted directly on the mixer fender of a ready mix truck.

Accordingly, it is a principal object of the invention to provide an easily portable emergency hydraulic pump unit for providing power to rotate the drum of a ready mix truck after an unplanned failure.

It is another object of the invention to provide a portable hydraulic pump that can be mounted to the mixer fender of a concrete truck to provide emergency power to rotate the drum.

It is a further object of the invention to provide a minimum flow rate hydraulic pump for providing emergency pumping capacity to operate the hydraulic motor of a ready mix truck to rotate the drum of a ready mix truck.

Still another object of the invention is to provide an emergency hydraulic pump that can be transported to a remote cite for installation on a ready mix truck.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings. The present invention

DETAILED DESCRIPTION OF THE PREFERRED EMBODIMENT(s)

A preferred embodiment of the present invention relates to a portable pump system 10 that is designed to provide emergency hydraulic power to run the hydraulic motor connected to the drum of a ready mix truck to prevent the concrete from prematurely setting in the drum and to provide sufficient power to add a retarder or water to the concrete and to unload the concrete before settling occurs.

Figure 1:
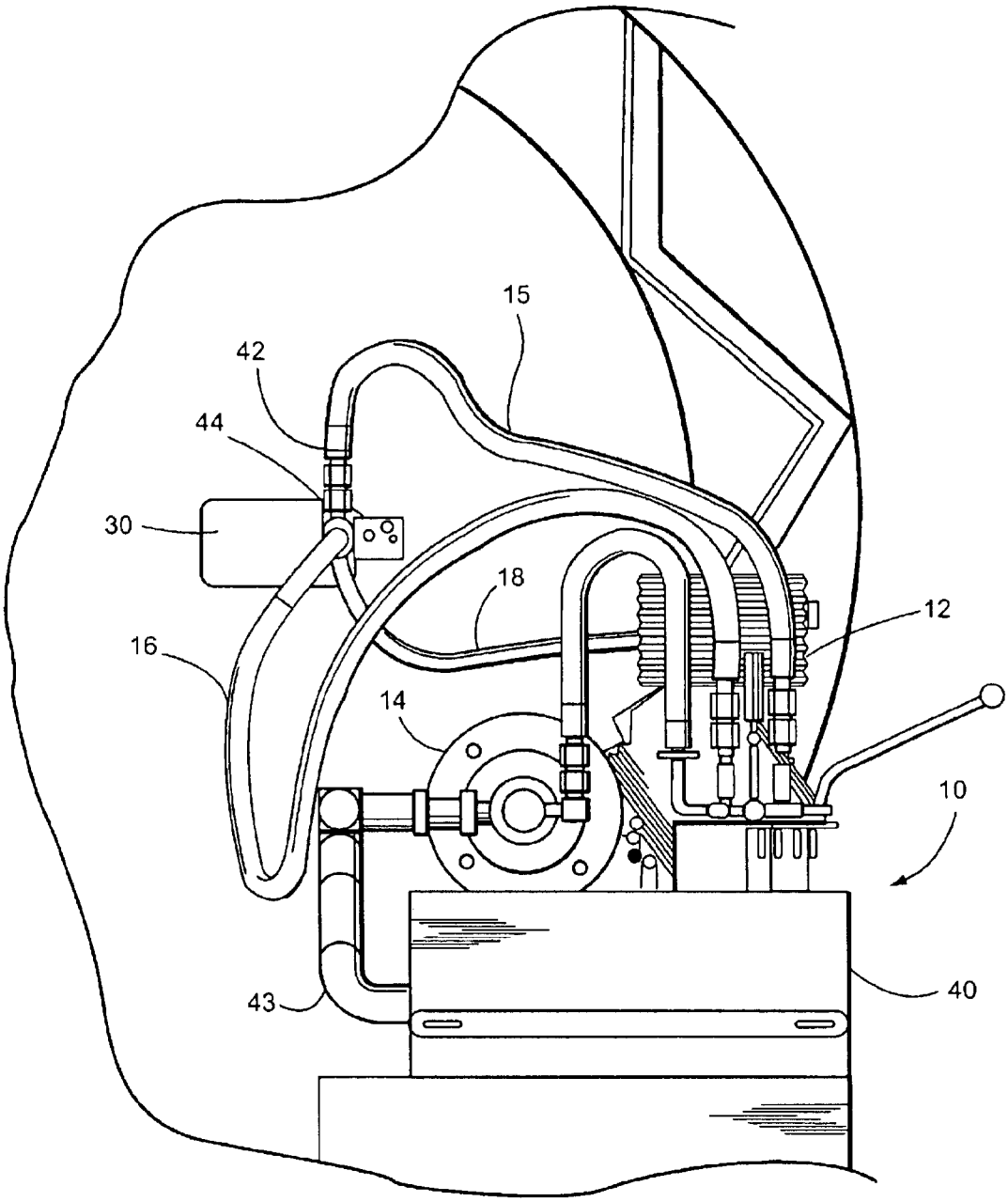
FIG. 1 is a partial, exploded front view of the portable pump according to a preferred embodiment of the current invention.
Figure 2:
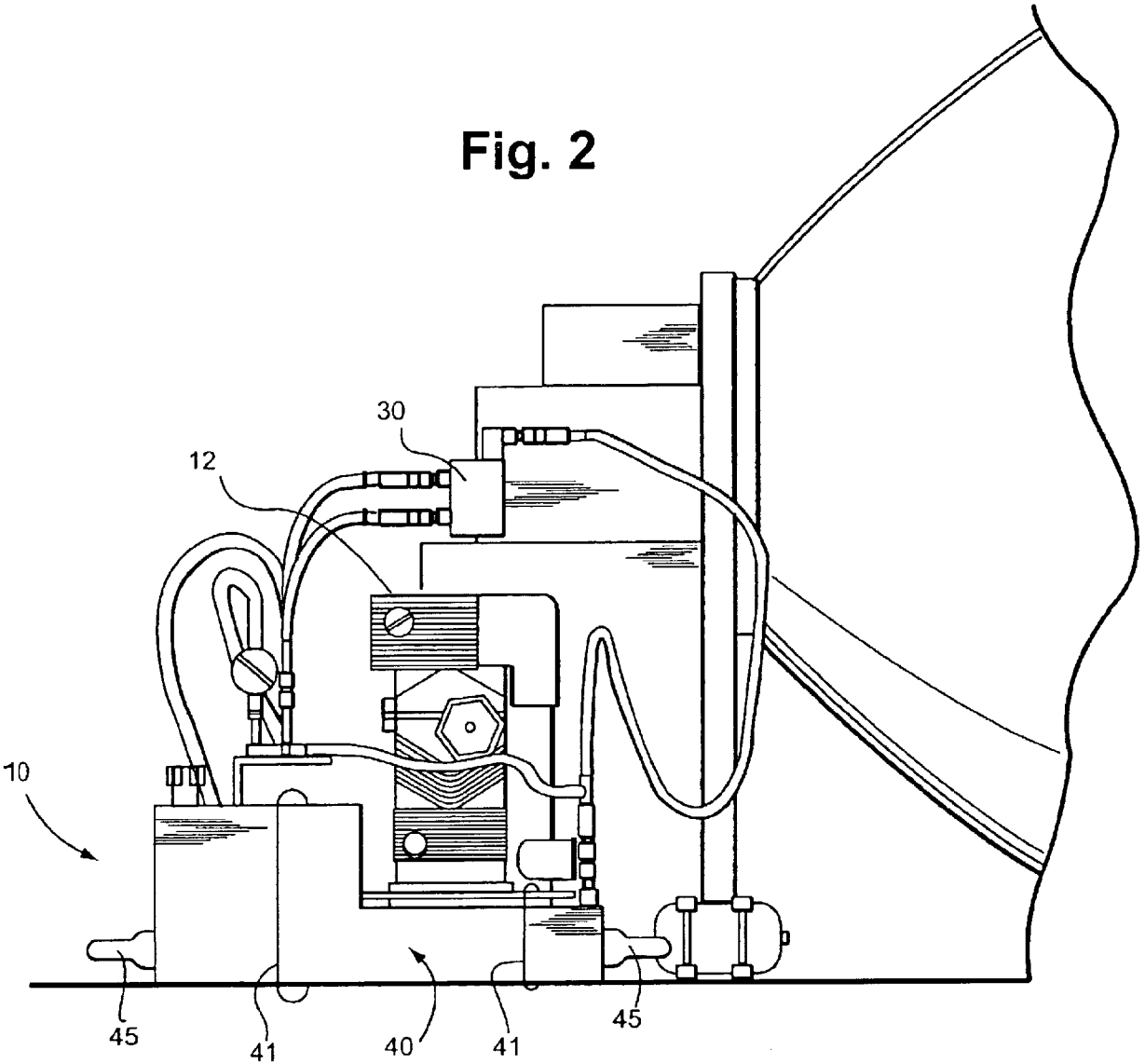
FIG. 2 is a partial, exploded side view of the portable pump according to a preferred embodiment of the current invention.
Figure 3:
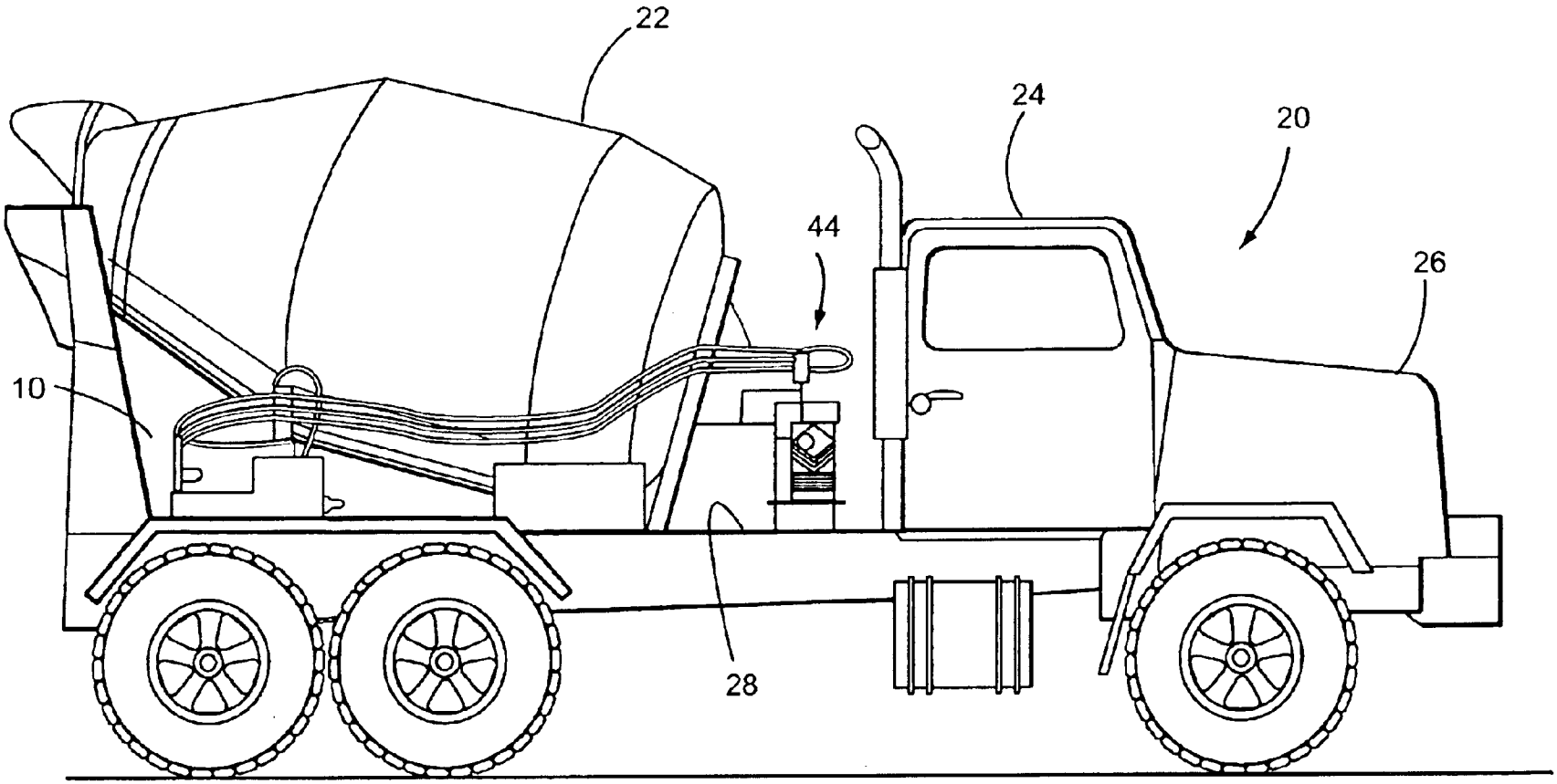
FIG. 3 is a side view of a rear discharge mixer truck having a portable pump mounted according to a preferred embodiment of the current invention.

As shown in FIGS. 1–3, a ready mix truck 20 has a drum 22 mounted on the frame of the truck. A cabin portion 24 is provided at the front end to house the driver (not shown) and the motor 26. A drive shaft (not shown) on the front of the engine (or analogous take off gear) of the truck provides power to run a pump (not shown) mounted intermediate the engine and the drum. The hydraulic pump provides motive force to pressurize the hydraulic motor which is mounted to the mixer gear box connected to the drum. Rotation of the gear causes the drum to rotate. During normal operation, the drum can rotate up to 12–14 revolutions per minute ("rpm"). This allows for the fast and efficient mixing of the concrete on site before the concrete is unloaded for the particular application required.

If the drum stops rotating for any reason, the concrete will begin to set. The amount of time that it takes to set depends on many factors including the particular mix used, the temperature, humidity, etc. However, it is generally recognized that in as little as a half hour to three hours, the concrete can set enough to prevent removal of the concrete from the drum thereby making the drum permanently inoperable. Once the concrete is set in the drum, the concrete will either have to be broken up inside the drum if the drum is valuable enough to save, or the drum will have to be replaced.

Each of these options requires significant man power and expense, either to jack hammer the concrete into small bits for removal or utilization of cranes and equipment to remove the damaged drum from the truck and to install a new drum. The costs associated with these processes can easily exceed $10,000, a high cost to bare especially considering the immense number of small concrete operations across the United States.

According to a preferred embodiment of the present invention, an alternative to watching the concrete set in the drum is available. The present invention contemplates a small portable pump system 10 capable of providing sufficient pressure to the hydraulic motor 30 to allow the drum 22 to rotate at a much reduced speed, around 2 rpm, which will allow both the mixing of a retarder or water completely into the concrete and unloading of the concrete before it sets. The pump is designed to mount directly to the mixer fender 28 of a ready mix truck of either the front discharge or rear discharge type to power the drum.

The pump system 10 is a self-contained ("self-driven") unit operated by a gas powered engine ("drive system") 12. The pump is made portable by running the drum at an unexpectedly low range. While the normal 12–14 rpm provides for the truck operator to quickly mix concrete and pour the concrete on site, when a truck is disabled, saving several minutes of preparation time is not nearly as important as saving thousands of dollars in potential losses. The 2 rpm provided by the emergency pump is sufficient to thoroughly mix in a retarder or water which will delay setting of the concrete for a period of up to 24 hours. A low flow rate somewhere in the range of 8 gallons per minute in the emergency hydraulic pump has been found to be sufficient to provide a final rotational speed of the ready mix drum of 2 rpm. By targeting this emergency rotational speed instead of trying to emulate a fully functional drum, the flow rate and pressure requirements can be reduced to such a degree as to allow smaller, portable system to be used. Thus instead of requiring a separate trailer to be used to transport a system to a disabled vehicle, a small, self-contained pump can be used which can mount directly to the mixer fender of a ready mix truck.

The pump itself is preferably a single stage gear pump 14, the operation of which is well known, and will not be described here. The pump preferably is capable of generating pressures up to about 2750 psi and a flow rate of 8 gallons per minute, sufficient to rotate a standard drum on a ready mix truck at about 2 revolutions per minute ("rpm"). This rate has been found to be sufficient to thoroughly mix a retarder and water into the ready mix or concrete to substantially delay and prevent setting of the concrete for up to 24 hours. This revolution rate has also been found sufficient to steadily and completely unload the concrete from the drum. While faster rates will increase the speed with which the retarder or water can be mixed or the concrete unloaded, the lower speeds are sufficient to fully perform the function and allows for a much lighter, more portable pump to be used. This allows a never-before-seen hand portable pump system to be used which can quickly be mounted on a mixer fender of the truck, or if a different style truck is used, then placed at any other convenient location on or next to the truck.

The pump system 10 preferably includes a number of hydraulic lines which are designed to be attached to the pump 14. First and second high pressure lines (15, 16) and a bleed line 18 are included in the preferred body of the pump system 10. The distal ends of the hoses are designed and shaped to be received by the hydraulic motor 30 of the ready mix truck.

In operation, when the rotation of a drum is interrupted by an engine failure or pump failure, it is necessary to unload the drum. The truck operator will call his company or a repair facility to request an emergency hydraulic pump be brought to his truck to rescue the concrete before it sets. The portable hydraulic pump is then prepared for installation by straping (i.e., with tie down straps) or otherwise affixing the pump to the mixer fender of the truck. Commonly on the ready mix trucks of either the front discharge (i.e., those trucks whose drum opens towards the front of the truck) or rear discharge trucks (i.e., those trucks whose drums open towards the rear of the truck) will have an area near the back end of the truck with sufficient free space to mount additional equipment. The integrated hydraulic pump system 10 will preferably have a housing or platform 40 that forms the pump, the motor and necessary equipment into an integral unit. The housing preferably has openings for receiving straps 41 or other means for securing the integrated pump and motor housing to the truck. As seen in FIG. 1, piping 43 operatively connects the pump 14 to the housing 40 where fluid is stored so that fluid can be conveyed between the housing 40 and the pump 14. As seen in FIG. 2, a pair of handles 45 extend outwardly from the fluid housing 40.

Once secured on the truck, the hydraulic hoses, if not already attached to the emergency pump, are connected to the appropriate ports of the pump. The pump may have quick connectors 42 or threaded connectors or other means for receiving a hydraulic line to the pump. The hoses of the ready mix truck hydraulic motor are then disconnected from the no-longer running truck hydraulic pump to prepare for receipt of the emergency pump hydraulic lines. The remote ends of the emergency pump hydraulic lines (15, 16, 18) are then connected to the appropriate hydraulic ports 44 of the concrete truck hydraulic motor using quick connects, threaded fasteners or similar devices known in the art. If necessary the lines and/or devices can be bled, but it is envisioned with the current arrangement and by preferable use of a gear pump for the emergency pump that bleeding of the hydraulic lines is not necessary before operation of the pump.

Figure 4:
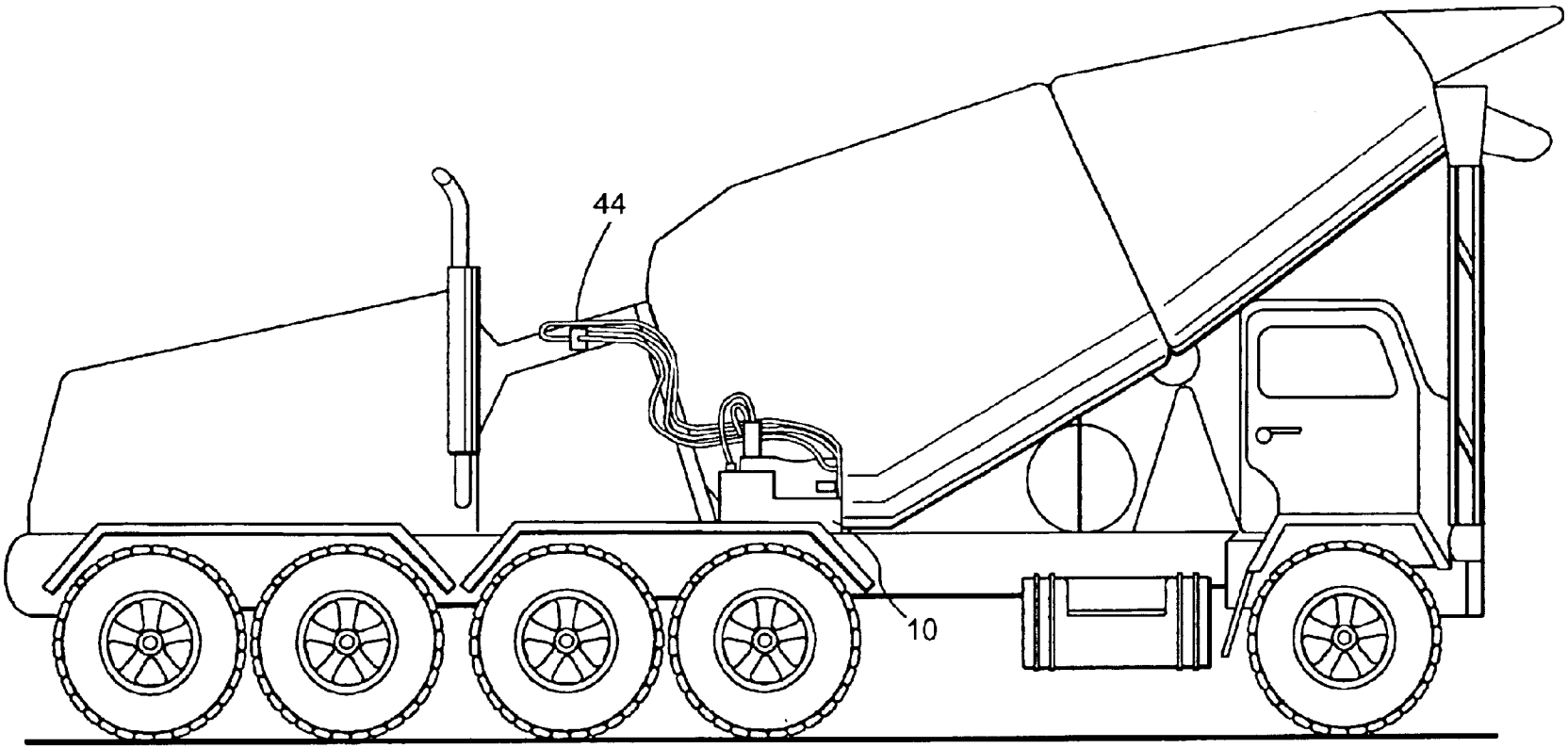
FIG. 4 is a side view of a front discharge mixer truck having a portable pump mounted according to a preferred embodiment of the current invention.

It should be noted that since the hydraulic motor of a front discharge truck (FIG. 4) will generally be near the rear where the pump is located and the hydraulic motor of a rear discharge truck (FIG. 3) will be near the front, it may be necessary to supply longer hydraulic hoses ("lines") with the emergency pump to ensure that the lines have sufficient length to run from the emergency pump mounted on the truck to the hydraulic motor. Due to the high pressure associated with the pump and motor in the thousands of psi, it may be desirable to use lines that are as short as possible to reduce losses and to reduce the chance of line failure or leaks.

With the hydraulic lines secure, the emergency pump is operated by starting the motor of the emergency pump unit. The gear pump rotates causing increased pressure in the desired direction along the hi-pressure hydraulic line which is caused to flow through the line to the hydraulic motor. The hydraulic fluid pumped from the emergency pump to the hydraulic motor is then returned through the low pressure line where it can be drawn back into the pump for further cycling to the hydraulic motor. The hydraulic motor turns the gears on the gear box of the drum. As the gear rotates, the drum is driven to rotate as well. One skilled in the art will recognize that the exact manner in which the hydraulic motor translates motion to the drum is not part of the invention, but is merely dependent on the particular truck in use, which may of course change in the future without affecting the teaching of this invention.

In operation, once the drum has begun its rotation it is desirable to add a retarder or water to the concrete mixture in the drum. While this could be done prior to the restarting of the drum rotation, without the mixing action caused by rotation, the retarder or water would not be able to mix into the concrete and would thus be ineffective in retarding setting of the concrete. It has been found that even the slow 2 revolutions per minute minimum generated by the emergency drum jumper is sufficient to mix the retarder or water sufficiently through the entire concrete mixture in a drum of standard ready mix truck. The retarders are available in the market and generally will prevent the concrete setting for up to an additional 24 hour period of time.

With the emergency pump mounted on the truck mixer fender and since the emergency pump's power source, namely the integrated motor, is also mounted to the ready mix truck, the truck can be towed or otherwise moved to an appropriate location to unload the concrete. Or if the truck is already in an appropriate location, then unloading can begin. The 2 revolutions per minute provided by the emergency pump driven hydraulic motor is sufficient to unload the concrete according to the normal operation of the ready mix truck. Once the drum is unloaded the emergency pump can be shut down and the truck repaired as necessary without the former time constraints and concerns about the concrete setting in the drum destroying the operability of the drum. By saving the drum from the setting concrete, substantial savings can be realized.

Further, because the pump is designed to run at the lower pressures and flow rates, it is possible to use non-dedicated personnel and vehicles to deliver the emergency pump to the desired location. For instance, the pump could be delivered by office personnel in a standard automobile or even an ATV or other small vehicle alleviating concerns about being able to access the ready mixer truck with a trailer in tow or reserving commercial vehicles and equipment for rescue situations. And further since the pump mounts directly to the truck, it is not required that a large area around the truck be clear to maneuver a rescue vehicle or rescue trailer beside or near the mixer truck.

It is to be understood that the present invention is not limited to the sole embodiment described above, but encompasses any and all embodiments within the scope of the following claims.

I claim:

1. A system for providing emergency hydraulic power to drive a drum of a mixer truck, said system including:

(a) a mixer truck having a rotatable drum for mixing a material, said mixer truck having a drive assembly for rotating said drum, at least one component of said drive assembly being disabled such that said drum cannot be rotated;

(b) a portable emergency power unit being removably mounted on a portion of said mixer truck to provide emergency power to rotate said drum to avoid setting of the material in the drum, said portable emergency power unit includes a hydraulic pump, an engine and at least one connecting member, said connecting member connects said hydraulic pump to a portion of said drive assembly of said mixer truck so that said drum can be driven despite the disabled component of said drive assembly of said mixer truck to prevent setting of the material in the drum.

2. A system as set forth in claim 1, wherein:

(a) said portable emergency power unit is smaller than the drive assembly of the mixer truck wherein said portable emergency power unit cannot rotate the drum as fast as the drive assembly of the mixer truck when the drive assembly of the mixer truck is operable.

3. A system as set forth in claim 1, wherein:

(a) said drive assembly of said mixer truck has sufficient power to rotate said drum at a speed of at least 10 revolutions per minute when not disabled; and, (a) said portable emergency power unit is sufficiently small so that it can only rotate the drum of the mixer truck speed less than 10 revolutions per minute.

4. A system as set forth in claim 1, wherein:

(a) said drive assembly of said mixer truck has sufficient power to rotate said drum at a speed of at least 12 to 15 revolutions per minute when not disabled; and, (b) said portable emergency power unit is sufficiently small so that it can only rotate the drum of the mixer truck at a speed less than 3 revolutions per minute.

5. A system as set forth in claim 1, wherein:

(a) said portable emergency power unit rotates the drum at 1¾ to 2¼ revolutions per minute.

6. A system as set forth in claim 1, wherein:

(a) said portable emergency power unit includes a plurality of high pressure lines for providing hydraulic power to said drive assembly of said mixer truck.

7. A system as set forth in claim 1, wherein:

(a) said hydraulic pump of said portable emergency power unit generates approximately 2750 psi.

8. A system as set forth in claim 1, wherein:

(a) said hydraulic pump of said portable emergency power unit pumps hydraulic fluid at approximately 8 gallons per minute.

* * * * *